United States Patent [19]

Bakr et al.

[11] Patent Number: 4,690,466

[45] Date of Patent: Sep. 1, 1987

[54] SEWING MACHINE CABINET AND LIFT

[75] Inventors: Mamdouh M. Bakr, Little Rock; Bobby J. Maloney, Trumann, both of Ark.

[73] Assignee: Delta Wood Products, Inc., Trumann, Ark.

[21] Appl. No.: 868,565

[22] Filed: May 30, 1986

[51] Int. Cl.[4] ..... A47B 81/00

[52] U.S. Cl. ..... 312/29; 312/208; 112/217.1

[58] Field of Search ..... 312/208, 21, 350, 344, 312/29, 25, 28; 108/20, 147; 112/217.1, 217.2; 49/362

[56] References Cited

U.S. PATENT DOCUMENTS

| | | | |
|---|---|---|---|
| 962,700 | 1/1910 | Davis | 312/29 |
| 2,635,255 | 4/1953 | Holden | 312/344 |
| 2,669,790 | 2/1954 | Wells . | |
| 2,870,460 | 1/1959 | Sanford | 5/63 |
| 3,797,819 | 3/1974 | Piatz et al. | 269/322 |
| 3,918,780 | 11/1975 | Fritts | 312/30 |
| 3,993,008 | 11/1976 | Parsons | 112/217.1 |
| 4,065,194 | 12/1977 | Mattia | 312/247 |
| 4,170,847 | 10/1979 | Pickles | 49/362 |
| 4,568,132 | 2/1986 | Watt | 312/272 |

FOREIGN PATENT DOCUMENTS

| | | | |
|---|---|---|---|
| 1923426 | 11/1970 | Fed. Rep. of Germany | 112/217.1 |
| 1474259 | 2/1967 | France | 112/217.1 |

*Primary Examiner*—Kenneth J. Dorner
*Assistant Examiner*—Gerald A. Anderson
*Attorney, Agent, or Firm*—Hill, Van Santen, Steadman & Simpson

[57] ABSTRACT

A sewing machine cabinet is provided with a lift mechanism which will move the sewing machine vertically on a platform between a normal operating position, a lower stored position and a raised operating position. A rack and pinion lift mechanism is utilized along with a vertical track which has flanges to shield the pinch point between the rack and pinion as well as providing guide surfaces for rollers engagable with the rack. Switches are provided for manual movement and automatic stopping of the sewing machine lift mechanism. A release flap is provided on the top surface of the cabinet to prevent the formation of a pinch point between the flap and the surface as the platform rises to an operative position.

17 Claims, 7 Drawing Figures

SEWING MACHINE CABINET AND LIFT

BACKGROUND OF THE INVENTION

1. Field of the Invention

This invention relates to the field of cabinets for housing sewing machines and particularly directed toward power operated lift devices for moving the sewing machine between a stored position and two vertically spaced working positions.

2. Description of the Prior Art

It is known in the art to provide vertical movement for sewing machines between a stored position and a use position such as taught by U.S. Pat. No. 3,993,008 and 3,918,780.

U.S. Pat. No. 3,993,008 discloses a sewing machine lift which utilizes a captured and rotating screw thread to lift the carriage carrying the sewing machine. U.S. Pat. No. 3,918,780 stores the sewing machine in a downwardly pivoted arrangement and provides for the sewing machine to be positioned in a first lower operating position and elevated to a second operating position by means of rotation of a relatively complex gearing arrangement.

A rack and pinion drive arrangement is disclosed in U.S. Pat. No. 2,669,790 for raising and lowering display devices. The rack is completely exposed to the interior of the cabinet and the meshing point of the rack with the pinion is likewise exposed which could cause a hazardous condition.

SUMMARY OF THE INVENTION

The present invention provides a sewing machine cabinet and lift mechanism wherein the lift is provided by a rack and pinion mechanism and a guide track. The rack is mounted on the track in an inaccessible location to protect the engagement area between the rack and the pinion to increase the safety considerations of the device. The lift platform has wheeled brackets mounted thereon which engage the track to provide a smooth and rigid guide.

Sensor switches are used to stop movement of the lift mechanism in a vertical direction based on the particular activation switch which is utilized. A first activation switch is used to raise the lift platform from a storage height to a first working height which places the sewing machine arm level with the cabinet top. A second switch is utilized to raise the platform so that the sewing machine arm is above the normal cabinet height which is useful in sewing sleeves and similar garment parts. If the platform is stopped between the storage position and the normal position, either switch could be used to lower the platform to the storage position. If the platform is stopped between the normal position and the elevated position, either switch could be used to move the platform to the elevated position.

The cabinet and lift mechanism of the present invention provides a simple, safe and relatively uncomplicated and thus relatively inexpensively manufacturable lifting mechanism for a sewing machine cabinet.

DESCRIPTION OF THE PREFERRED EMBODIMENTS

Figure 1:
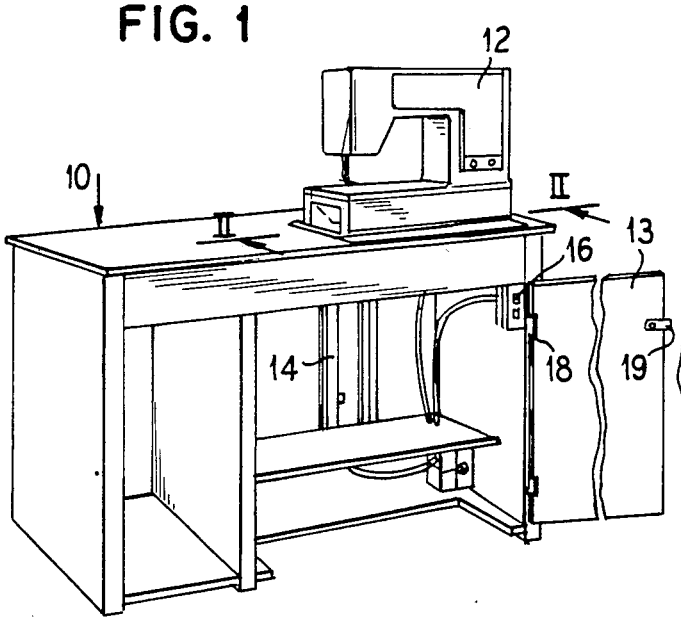
FIG. 1 is a perspective view of a sewing machine cabinet and lift.

In FIG. 1 there is shown a sewing machine cabinet generally at 10 having a sewing machine 12 thereon and having an openable door 13. The sewing machine cabinet 10 is equipped with a lift mechanism of which a part is visible when the door 13 is open. A lift track 14 is vertically arranged within the cabinet and a pair of control switches 16, 18 are provided for operating the lift device when the door is open. The door may be provided with a dead bolt lock 19 to prevent access to the interior of the cabinet which will enhance the safety considerations of the device.

Figure 3:
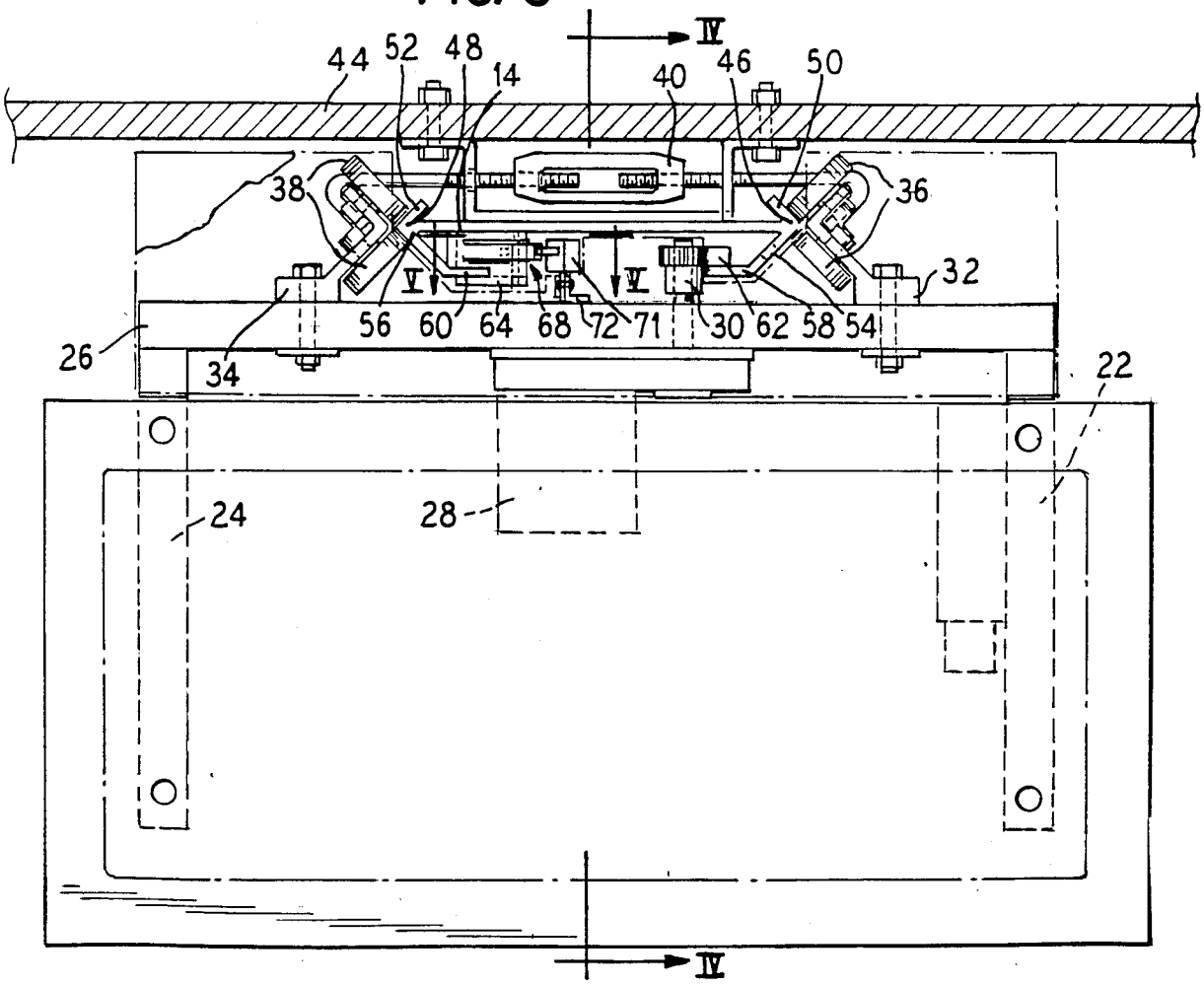
FIG. 3 is a sectional view through the lift track taken generally along the lines III—III of FIG. 2.
Figure 2:
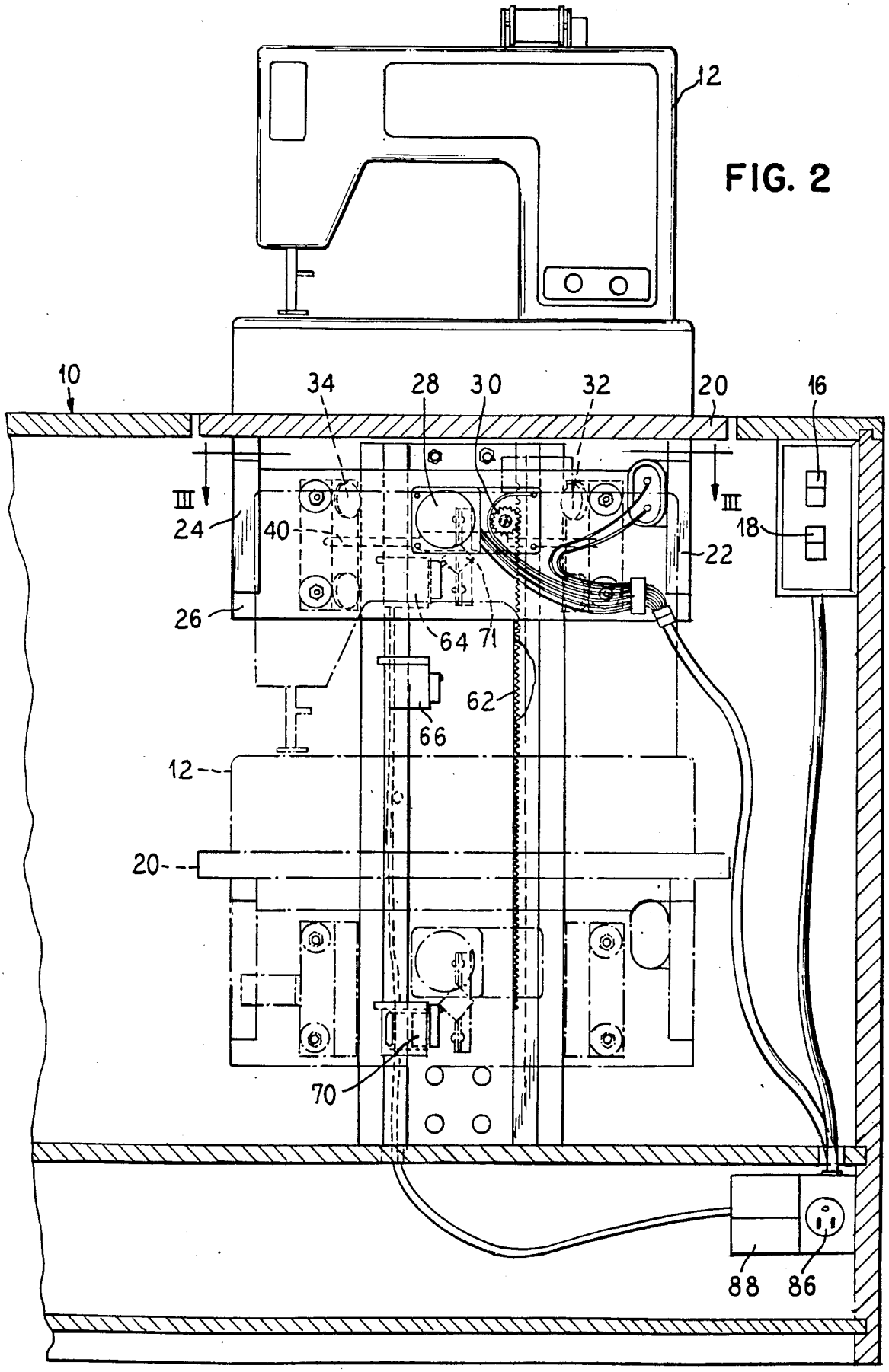
FIG. 2 is a partial sectional view of the cabinet illustrating the lift mechanism taken generally along the lines II—II of FIG. 1.

The lift mechanism is shown in greater detail in FIG. 2 where it is seen that the sewing machine 12 is carried on a platform 20 which is vertically movable. A top wall 21 of the platform 20 is dimensioned sufficiently smaller than an opening 22 in the cabinet top to prevent a pinch point therebetween as the platform is moved vertically in and out of alignment with the cabinet top. The platform 20 has two downwardly depending side walls 23, 24 and a back or rear wall 26. Mounted onto the back wall 26, as is better seen in FIG. 3, is an electric motor 28 having a gear connection to a rotating pinion 30. A resilient gasket 31 is provided between the motor 28 and the wall 26 to absorb vibration resulting from the gear-rack engagement motion. Mounted on the back side of the back wall 26 are a pair of spaced brackets 32, 34 on each of which are mounted two pairs of rollers 36, 38. Thus, each bracket is provided with a top pair of rollers and a lower pair of rollers, vertically spaced, each roller of each pair being fixed at 90° relative to the other roller of the pair, and the respective upper rollers being aligned with the lower rollers. The brackets 32, 34, preferably made of extruded aluminum, are designed to minimize the platform overhang relative to the track. One of the brackets 34 is adjustable in a horizontal direction. A turnbuckle and tie rod assembly 40 is used to secure the free end of the brackets 32, 34, to eliminate deflection of the brackets and maintain dimensional integrity of the assembly, and to keep the brackets from shaking loose under repeated use of the lift. The rollers 36, 38 are preferably of the type having frictionless bearings and a plastic material on the outer surface to minimize track wear.

Mounted on a back or rear wall 44 of the cabinet 10 is the guide track 14. The guide track preferably is fabricated of a light weight extruded aluminum track which is relatively inexpensive to manufacture. The track cross-section, as seen in FIG. 3, is designed to provide positive guidance for the platform motion, lateral rigidity against deflection by forces on the platform, as well as proper enclosure for the rack part of the rack and pinion drive and the wiring harness connected to the micro switches responsible for the positional stops of the lift platform.

Specifically, the track has two opposed flanges 46, 48 at opposite lateral sides of the track. Each of the flanges 46, 48 has a short obliquely rearwardly extending leg 50, 52 and a forwardly obliquely extending leg 54, 56 which is arranged in a perpendicular orientation to the respective rearwardly extending leg 50, 52. A front extension 58, 60 of the forward legs 54, 56 completes the opposed flanges. One of the extensions 58 (or it could be extension 60 if desired) has mounted on an interior side thereof a rack 62 comprising a plurality of gear teeth in a linear arrangement which is engagable by the toothed pinion gear 30. Thus, the rack is positioned in a relatively inaccessible position and the engagement point or pinch point between the rack and the pinion is effectively shielded by the front extension 58.

The perpendicular legs 50, 54 of the track 14 are engaged by the perpendicularly oriented roller pairs 36. Likewise, the perpendicular legs 52, 56 of the track are engaged by the roller pins 38. The turnbuckle and tie rod assembly 40 serves to ensure that engagement between the roller pairs and the track legs is maintained. Since the roller pairs 36, 38 are mounted on the rear of the platform rear wall 26, the engagement point between the rollers and the track is in effect shielded.

Positioned along the height of the track 60 are four separate micro switches 64, 66, 68 and 70 which are utilized to interrupt the power circuit for the motor 28 to stop rotation of the pinion 30. Mounted on the back side of the platform rear wall 26 is a switch actuator 70 carried on a bracket 72. The switch actuator. 70 moves along with the platform 20 and has an upper camming surface 74 and a lower camming surface 76 to engage with a switch arm 78 of the micro switch 66 to open the contact of the normally closed switch. Thus, the actuator 74 is operable against the micro switch arm 78 in either direction of movement, upwardly or downwardly.

Figure 5:
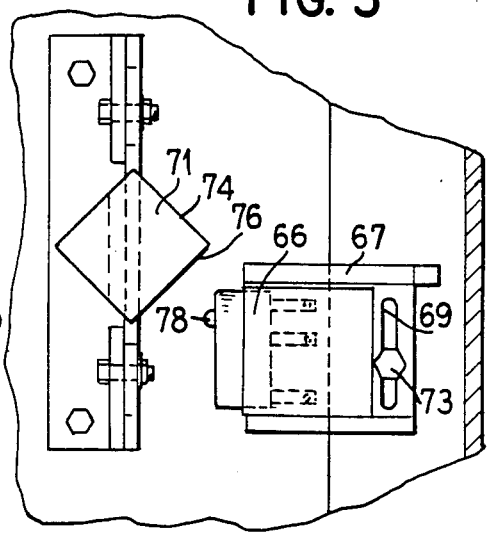
FIG. 5 is an elevational view of the sensing switch arrangement taken generally along the lines V—V of FIG. 3.

The height position of the microswitches 64, 66, 68 and 70 is adjustable to accomodate various makes of sewing machines which would have different base heights. As seen in FIG. 5 the micro switch 66 is carried on a bracket 67 which has a vertical slot 69 therein. A fastener 73 such as a screw passes through the slot 69 to hold the bracket 67 in a fixed location. However, by loosening the fastener 73, the brackets 67 and micro switch 66 can be vertically repositioned.

The wire harness and switch enclosures are designed with loops and pinch points to allow for the necessary vertical adjustment without undue strain on the electrical wires connected to the micro switches. As seen in FIG. 2, the wiring interconnecting the micro switches with the remainder of the circuitry, which can be in the form of a wire harness, is carried along inside of the track 14 behind the front flange extension 60 so that the wiring is protected and is not engaged by the moving platform.

Figure 4:
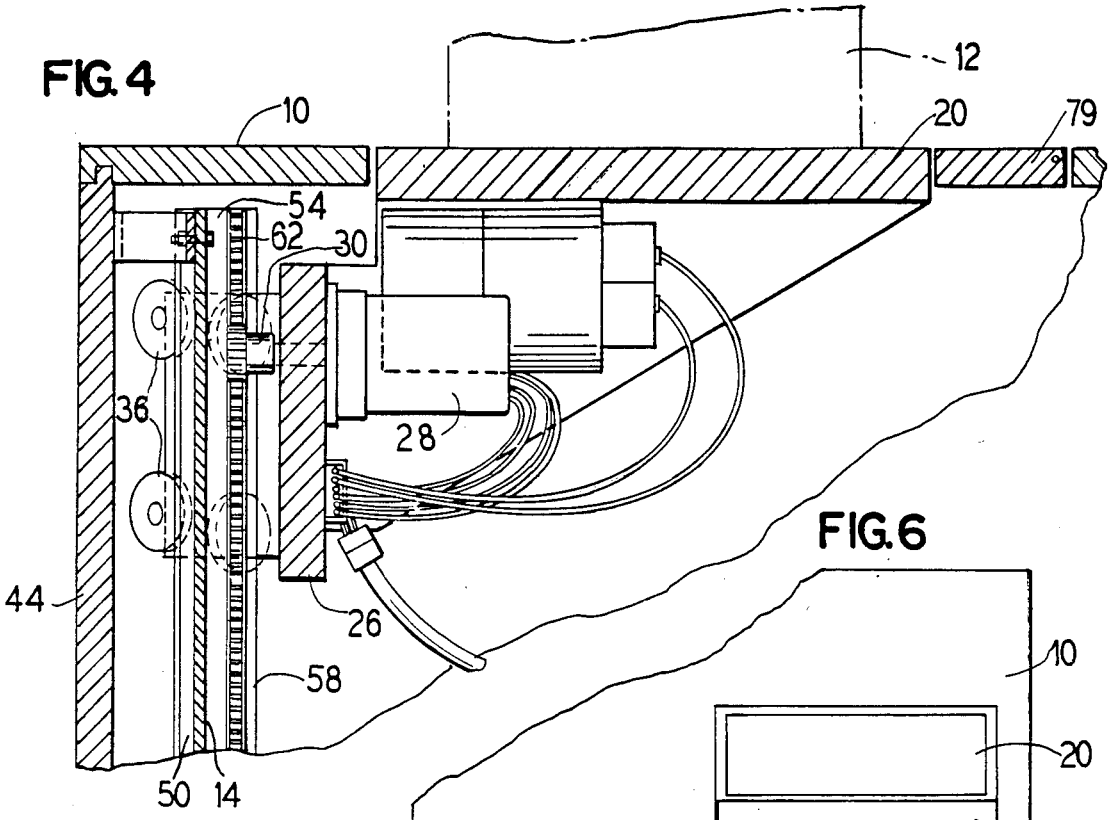
FIG. 4 is a sectional view through the lift track showing the rack and pinion drive mechanism taken generally along the lines IV—IV of FIG. 3.
Figure 6:
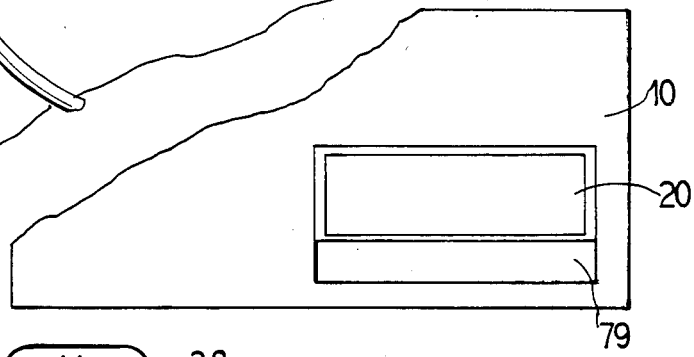
FIG. 6 is a partial plan view of the top of the cabinet.

As illustrated in FIGS. 6 and 4, release flap 79 is provided in the top surface of the cabinet which has a pivotable connection to the remainder of the top of the cabinet. The use of the release flap 79 permits a close spacing between the flap 79 and the platform 20 while preventing a pinch point. If an obstruction, such as the user's finger, is in the gap between the flap 79 and the platform 20 as the platform is rising to the working position, the release flap will merely pivot upwardly preventing any dangerous situation. After the obstruction is removed, the flap will return to a normal horizontal position by gravity.

Figure 7:
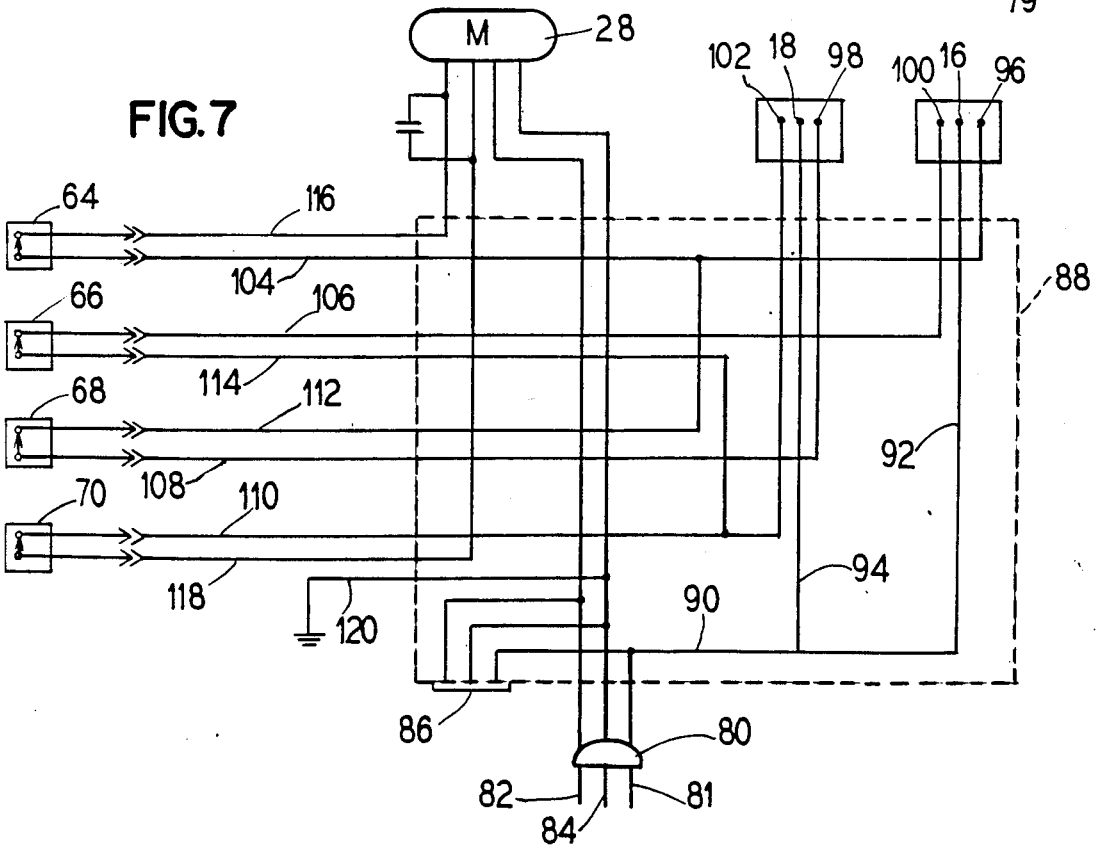
FIG. 7 is a schematic diagram of the electrical control circuitry utilized with the lift mechanism.

The electrical control circuitry or circuit means for the motor is illustrated in FIG. 7. The motor is preferably a properly matched, reversible, 1/100 horsepower, 18 idle rpm permanent split capacitor gear motor. The gear motor employs a braking system which is engaged when power is disrupted to the gear motor. The motor 28 is connected to a source of power and the various switches. A plug 80 is engaged into normal household electrical receptacle and has a three prong connection, a first prong 81 being connected to a source of 120 volts 60 cycle alternating current, a second prong 82 being a common prong and a third prong 84 being a ground prong. An additional receptacle 86 is wired directly to the power cord to provide an additional outlet within the cabinet 10. Such a receptacle 86 can be contained in a junction box 88 mounted in the cabinet.

The two switches 16, 18 which are utilized to move the platform vertically comprise rocker switches which require constant finger pressure for operation and which provide for instant stopping when finger pressure is released. The force required to activate the rocker switches is preferably great enough to make it difficult for young children to operate the switches. As noted above, the door 13 of the cabinet 12 may be provided with the lock 19 to prevent access to the control switches when the sewing machine is not in use.

The 120 volt line from prong 80 is connected to switches 16 and 18 via lines 92, 94 respectively. The rocker switches have a contact 96, 98 respectively for causing upward movement of the platform and a contact 100, 102 respectively for downward movement. The rocker switch 16 for moving the platform to the elevated position is connected to micro switches 64 and 66 via lines 104 and 106 respectively. Rocker switch 18 which is utilized to move the platform to the normal position is connected to micro switches 68, 70 via lines 108, 110 respectively. The rocker switch 16 is also connected to micro switch 68 via line 112 and rocker switch 18 is connected directly to micro switch 66 via line 114. Micro switches 64 and 70 are connected to the motor 28 via lines 116 and 118 respectively. The track itself may be grounded via line 120.

When the platform 20 is in the lower, or stored position, micro switch 70 is held in an open position and micro switches 64, 66 and 68 are closed. If rocker switch 18 is depressed for upward movement of the platform, contact 98 will be closed and power from line 94 will flow through line 108, through micro switch 68, line 112, line 104, micro switch 64, and line 116 to the motor 28 to cause rotation of the pinion and thus raising of the platform. When the platform reaches the normal working height, the switch actuator 70 will engage and open micro switch 68 thus terminating upward movement of the platform. At any point from the lower position through the normal position rocker switch 16 could be depressed for upward movement of the platform which would result in power flowing from line 92 across contact 96, along lines 104 and 116 to the motor 28. Upward movement of the platform would not stop until the platform arrived in the elevated position.

To move from the elevated position to the normal position, the rocker switch 16 would have to be depressed for downward movement which would cause power to flow from line 92 through contact 110 along line 106, through micro switch 66, along lines 114 and 110, through micro switch 70 and along line 118 to reverse the rotation direction of the motor 28. Power to the motor would terminate when the actuator 70 engaged micro switch 66 to break the circuit. At any point of travel of the platform, rocker switch 18 could be depressed for downward movement which would cause power to flow from line 94 through contact 102 along line 110, through switch 70 and along line 118 to the motor 28. Power to the motor would not terminate until the platform reached the stored position.

If the platform is stopped between the storage position and the normal position, either switch could be used to lower the platform to the storage position. If the platform is stopped between the normal position and the elevated position, either rocker switch could be used to move the platform to the elevated position.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. A sewing machine cabinet and lift combination comprising:

a cabinet having a rear wall and a top wall, said top wall having an opening to permit movement of a sewing machine therethrough;

a platform having a top wall which is sized to pass through said cabinet top wall opening for receiving the sewing machine, and a rear wall attached to said top wall;

a vertical track secured to said rear wall of said cabinet, on the interior side thereof, said track having two pairs of vertical wall flanges, each pair comprising walls formed perpendicularly to each other;

a linear gear toothed rack secured to said track; roller means secured to said rear wall of said platform to rollingly engage said track, said roller means comprising pairs of perpendicularly arranged rollers engagable with said track wall flanges;

an adjustment means on at least one pair of said roller means to ensure that engagement is maintained between said rollers and said wall flanges;

a reversible electric motor mounted on said platform;

a gear tooth pinion driven by said motor and engagable with said rack to move said platform vertically upon operation of said motor;

a switch operable through a circuit means to supply power to said motor to move said platform along said track between a lower stored position and a normal operative position;

a switch operable through said circuit means to supply power to said motor to move said platform along said track between said normal operative position and an elevated position;

said circuit means including additional switches engagable by an actuator on said platform to interrupt power to said motor when said platform is at said lower, normal and elevated positions.

2. A combination according to claim 1, wherein said adjustment means comprises a turnbuckle and the rod assembly interconnecting said two pairs of roller means to hold them against said wall flanges.

3. A combination according to claim 1, wherein said track has a flange with a front extension and said rack is mounted on an inside of said extension such that the pinch point between said rack and said pinion is shielded by said front extension.

4. A combination according to claim 1, wherein said engagement point between said roller means and said track is shielded by said rear wall of said platform.

5. A combination according to claim 1, including a release flap provided on said top wall of said cabinet adjacent said opening to prevent the formation of a pinch point between said platform and said cabinet top wall as said platform rises to said elevated position.

6. A cabinet and lift combination comprising:

a cabinet having a rear wall and a top wall, said top wall having an opening therethrough;

a platform having a top wall which is sized to pass through said cabinet top wall opening and a rear wall attached to said top wall;

a vertical track secured to a first of said rear walls;

roller means secured to a second of said rear walls to rollingly engage said track;

a linear gear toothed rack secured to said track;

a reversible electric motor mounted on said second rear wall;

a gear toothed pinion driven by said motor and engagable with said rack to move said platform vertically upon operation of said motor;

said track having a flange with a front extension and said rack being positioned on an inside of said extension such that the pinch point between said rack and said pinion is shielded by said front extension;

switch means manually operable through a circuit means for moving said platform between a lower stored position and an elevated operating position; and additional switch means operable through said circuit means for automatically stopping the movement of said platform at least at said stored position and said elevated operating position as selected by manual operation of said manually operable switch means.

7. A combination according to claim 6, wherein said second switch means are vertically adjustable to provide stoppage of said platform at different selected heights.

8. A combination according to claim 6, wherein said vertical track has two pairs of vertical wall flanges, each pair comprising walls formed perpendicularly to each other and said roller means comprising pairs of perpendicularly arranged rollers engagable with said track wall flanges.

9. A combination according to claim 8, including an adjustment means on at least one pair of said roller means to ensure that engagement is maintained between said rollers and said wall flanges.

10. A combination according to claim 9, wherein said adjustment means comprises a turnbuckle and tie rod assembly interconnecting said two pairs of roller means to hold them against said flange.

11. A combination according to claim 6, wherein said engagement point between said roller means and said track is shielded by said rear wall of said platform.

12. A combination according to claim 6, including a release flap provided on said top wall.

13. A sewing machine cabinet and lift combination comprising:

a cabinet having a rear wall and a top wall, said top wall having an opening to permit movement of a sewing machine therethrough;

a platform having a top wall which is sized to pass through said cabinet top wall opening for receiving the sewing machine, and a rear wall attached to said top wall;

a vertical track secured to said rear wall of said cabinet, on the interior side thereof, said track having two pairs of vertical wall flanges, each pair comprising walls formed perpendicularly to each other;

a linear gear toothed rack secured to said track;

roller means secured to said rear wall of said platform to rollingly engage said track, said roller means comprising pairs of perpendicularly arranged rollers engagable with said track wall flanges;

a reversible electric motor mounted on said platform;

a gear toothed pinion driven by said motor and engagable with said rack to move said platform vertically upon operation of said motor;

a switch operable through a circuit means to supply power to said motor to move said platform along said track between a lower stored position and a normal operative position;

a switch operable through said circuit means to supply power to said motor to move said platform along said track between said normal operative position and an elevated position where said platform is coplanar with said cabinet top wall;

said circuit means including additional switches engagable by an actuator on said platform to interrupt power to said motor when said platform is at said lower, normal and elevated positions;

a release flap pivotally connected to said top wall of said cabinet adjacent said opening to prevent the formation of a pinch point between said platform and said cabinet top wall as said platform rises to said elevated position.

14. A combination according to claim 13, including an adjustment means on at least one pair of said roller means to ensure that engagement is maintained between said rollers and said wall flanges.

15. A combination according to claim 14, wherein said adjustment means comprises a turnbuckle and tie rod assembly interconnecting said two pairs of roller means to hold them against said wall flanges.

16. A combination according to claim 13, wherein said track has a flange with a front extension and said rack is mounted on an inside of said flange such that the pinch point between said rack and said pinion is shielded by said front extension.

17. A combination according to claim 13, wherein said engagement point between said roller means and said track is shielded by said rear wall of said platform.

* * * * *